United States Patent [19]

Talvalkar

[11] Patent Number: 4,923,749

[45] Date of Patent: May 8, 1990

[54] THERMAL TRANSFER RIBBON

[75] Inventor: Shashi G. Talvalkar, Kettering, Ohio

[73] Assignee: NCR Corporation, Dayton, Ohio

[21] Appl. No.: 224,042

[22] Filed: Jul. 25, 1988

[51] Int. Cl.[5] ..... B41M 5/20

[52] U.S. Cl. ..... 428/341; 428/195; 428/206; 428/207; 428/329; 428/342; 428/483; 428/484; 428/488.1; 428/500; 428/520; 428/522; 428/527; 428/537.5; 428/913; 428/914

[58] Field of Search ..... 428/195, 484, 488.1, 428/488.4, 913, 914, 207, 329, 342, 342, 480, 483, 527, 537.5, 206, 500, 520, 522

[56] References Cited

U.S. PATENT DOCUMENTS

| | | | |
|---|---|---|---|
| 3,418,148 | 12/1968 | Barz | 428/484 |
| 3,663,278 | 5/1972 | Blose et al. | 428/484 |
| 4,315,643 | 2/1982 | Tokunaga et al. | 428/484 |
| 4,340,655 | 7/1982 | Hollister et al. | 346/1.1 |
| 4,403,224 | 9/1983 | Wirnowski | 346/1.1 |
| 4,419,024 | 12/1983 | Bowlds et al. | 428/914 |
| 4,421,429 | 12/1983 | Graham | 428/914 |
| 4,424,245 | 1/1984 | Maruta et al. | 428/914 |
| 4,453,839 | 6/1984 | Findlay et al. | 428/914 |
| 4,628,000 | 12/1986 | Talvalkar et al. | 428/484 |
| 4,698,268 | 10/1987 | Ueyama | 428/914 |
| 4,707,395 | 11/1987 | Ueyama | 428/488.1 |

OTHER PUBLICATIONS

Product Data Sheet for Aqua Vinyl Primer, Product No. EC-1052.

*Primary Examiner*—Pamela R. Schwartz
*Attorney, Agent, or Firm*—Wilbert Hawk, Jr.; Albert L. Sessler, Jr.; George J. Muckenthaler

[57] ABSTRACT

A thermal transfer ribbon includes a substrate which has a thermal sensitive coating and a protective layer. The thermal sensitive coating is a solvent based wax mixture dispersed in a binder mix along with pigments. The protective layer is a water based mixture of ink, alcohol and carbon black which remains nonintegral with the thermal sensitive coating.

13 Claims, 2 Drawing Sheets

THERMAL TRANSFER RIBBON

BACKGROUND OF THE INVENTION

In the printing field, the impact type printer has been the predominant apparatus for providing increased throughput of printed information. The impact printers have included the dot matrix type wherein individual print wires are driven from a home position to a printing position by individual and separate drivers. The impact printers also have included the full character type wherein individual type elements are caused to be driven against a ribbon and paper or like record media adjacent and in contact with a platen.

The typical and well-known arrangement in a printing operation provides for transfer of a portion of the ink from the ribbon to result in a mark or image on the paper. Another arrangement includes the use of carbonless paper wherein the impact from a print wire or a type element causes rupture of encapsulated material for marking the paper. Also known are printing inks which contain magnetic particles wherein certain of the particles are transferred to the record media for encoding characters in manner and fashion so as to be machine readable in a subsequent operation. One of the known encoding systems is MICR (Magnetic Ink Character Recognition) utilizing the manner of operation as just mentioned.

While the impact printing method has dominated the industry, one disadvantage of this type of printing is the noise level which is attained during printing operation. Many efforts have been made to reduce the high noise levels by use of sound absorbing or cushioning materials or by isolating the printing apparatus.

More recently, the advent of thermal printing which effectively and significantly reduces the noise levels has brought about the requirements for heating of extremely precise areas of the record media by use of relatively high currents. The intense heating of the localized areas causes transfer of ink from a ribbon onto the paper or like receiving substrate. Alternatively, the paper may be of the thermal type which includes materials that are responsive to the generated heat.

The use of thermal transfer printing, especially when performing a subsequent sorting operation, can result in smearing or smudging adjacent the printed symbols or digits on the receiving substrate. This smearing can make character recognition, such as OCR (Optical Character Recognition) or MICR (Magnetic Ink Character Recognition), difficult and sometimes impossible.

The present invention provides a thermal transfer medium in the preferred form of a ribbon which eliminates or substantially reduces smearing or smudging across or adjacent the printed digits or symbols during the sorting operation.

Representative documentation in the area of nonimpact printing includes U.S. Pat. No. 3,418,148, issued to G. Barz on Dec. 24, 1968, which discloses a transfer medium comprising a carrier paper and a polyethylene film having two spaced dye pigment-free outer layers of polyethylene. One layer is bonded to the paper and an intermediate layer is between the outer layers and a mixture of polyethylene oil and dye pigment.

U.S. Pat. No. 3,663,278, issued to J. H. Blose et al. on May 16, 1972, discloses a thermal transfer medium having a coating composition of cellulosic polymer, thermoplastic resin, plasticizer and a sensible dye or oxide pigment material.

U.S. Pat. No. 4,315,643, issued to Y. Tokunaga et al. on Feb. 16, 1982, discloses a thermal transfer element comprising a foundation, a color developing layer and a hot melt ink layer. The ink layer includes heat conductive material and a solid wax as a binder material.

U.S. Pat. No. 4,340,655, issued to K. R. Hollister et al. on July 20, 1982, discloses a recording element with a recording layer, thermal and mechanical barrier layers, and an additional spacer layer. A top coat layer may be coated on the element.

U.S. Pat. No. 4,403,224, issued to R. C. Wirnowski on Sept. 6, 1983, discloses a surface recording layer comprising a resin binder, a pigment disbursed in the binder, and a smudge inhibitor incorporated into and disbursed throughout the surface recording layer, or applied to the surface recording layer as a separate coating.

U.S. Pat. No. 4,419,024, issued to P. A. Bowlds et al. on Dec. 6, 1983, discloses a mixture of setting polyamide, plastic polyamide, and graphite. The transfer medium has a resistive layer and an intermediate layer of silicon dioxide.

U.S. Pat. No. 4,421,429, issued to A. E. Graham on Dec. 20, 1983, discloses a thermal transfer ribbon having a thermal transfer layer and a resistive substrate of two polyamides and conductive particulate material.

U.S. Pat. No. 4,424,245, issued to K. Maruta et al. on Jan. 3, 1984, discloses a thermal recording label sheet having a support, a thermo-sensitive coloring layer on one side, a barrier layer on the other side, and an adhesive layer on the barrier layer.

U.S. Pat. No. 4,453,839, issued to H. T. Findlay et al. on June 12, 1984, comprises a thermal transfer medium having a non-tacky layer of marking material and a support layer with a release layer therebetween.

U.S. Pat. No. 4,628,000, issued to S. G. Talvalkar et al. on Dec. 9, 1986, discloses a thermal transfer formulation that includes an adhesive-plasticizer or sucrose benzoate transfer agent and a coloring material or pigment.

U.S. Pat. No. 4,698,268, issued to S. Ueyama on Oct. 6, 1987, discloses a heat resistant substrate and a heat-sensitive transferring ink layer. An overcoat layer may be formed on the ink layer.

And, U.S. Pat. No. 4,707,395, issued to S. Ueyama et al. on Nov. 17, 1987, discloses a substrate, a heat-sensitive releasing layer, a coloring agent layer, and a heat-sensitive cohesive layer.

SUMMARY OF THE INVENTION

The present invention relates to nonimpact printing. More particularly, the invention provides a coating formulation or composition and a thermal ribbon or transfer medium for use in imaging or encoding characters on paper or like record media documents which enable machine, or human, or reflectance reading of the imaged or encoded characters. The thermal transfer ribbon enables printing in quiet and efficient manner and makes use of the advantages of thermal printing on documents with a signal inducible ink.

Since the transferred digits or symbols which are created by means of thermal transfer technology, in effect, "sit" on the surface of the paper or media, a smearing of the ink of the digits or symbols is a major concern in the course of the document sorting operation.

The ribbon comprises a thin, smooth substrate such as tissue-type paper or polyester-type plastic on which is applied an undercoating or protective coating and a thermal functional coating. The protective coating is applied directly onto the substrate and serves as a protective layer for the thermal functional coating after the digit or symbol is transferred onto the receiving substrate. The functional coating comprises a thermal transfer layer or coating which generally includes a wax mixture dispersed in a binding mix of an ethylene copolymer or a hydrocarbon resin to form the wax emulsion. The hydrocarbon resin and the solids of the wax emulsion are mixed or dispersed into solution with oxide and coloring pigments in an attritor or other conventional dispersing equipment. The coloring pigments or dyes may include colors such as magenta, cyan, yellow or black and such pigments may also include a magnetic (iron) oxide. The thermal transfer coating is then applied to the substrate by well-known or conventional coating techniques.

The protective coating is applied to the substrate and the functional or thermal transfer coating is applied to the protective coating in a two-step process. The protective layer is provided to substantially reduce or eliminate image smearing or smudging of a printed nonmagnetic or a magnetic thermal transfer ribbon. The protective coating is water based and comprises a mixture of PVA, ink, sucrose benzoate, behenyl alcohol, carbon black, latex, and a phenolic type of anti-oxident or a phenolic resin. The thermal functional coating is solvent based and comprises a wax emulsion of hydrocarbon, paraffin and carnauba waxes and ethylene vinyl acetate copolymer. An iron oxide is added to the wax emulsion and the two coatings are applied on the substrate in the manner as mentioned above.

In view of the above discussion, a principal object of the present invention is to provide a ribbon including a thermal-responsive coating thereon.

Another object of the present invention is to provide a thermal transfer ribbon substrate including a coating thereon for use in imaging or encoding operations.

An additional object of the present invention is to provide a coating on a ribbon having ingredients in the coating which are responsive to heat for transferring a portion of the coating to paper or like record media.

A further object of the present invention is to provide a coating on a ribbon substrate, which coating includes a pigment material and a wax emulsion dispersed in a binder mix and which is responsive to heat for transferring the coating in precise printing manner to paper or like record media.

Still another object of the present invention is to provide a thermally-activated coating on a ribbon that is transferred from the ribbon onto the paper or document in an imaging operation in printing manner at precise positions and during the time when the thermal elements are activated to produce a well-defined and precise or sharp image.

Still an additional object of the present invention is to provide a protective layer and a thermal transfer layer consisting essentially of a wax emulsion and wherein the protective layer is provided to prevent smearing of printed images or other marks.

Still a further object of the present invention is to provide a two stage or two step process which includes the preparation of a specific wax emulsion and the preparation of a protective layer for use in a sorting operation.

Still another object of the present invention is to provide a heat sensitive, thermal transfer ribbon created by use of a water based protective coating or layer that is applied on a substrate, and a solvent based thermal functional coating wherein the two coatings are nonintegral with each other and the coating arrangement resists smearing or smudging of the transferred images or marks.

Additional advantages and features of the present invention will become apparent and fully understood from a reading of the following description taken together with the annexed drawing.

DESCRIPTION OF THE PREFERRED EMBODIMENT

Figure 1:
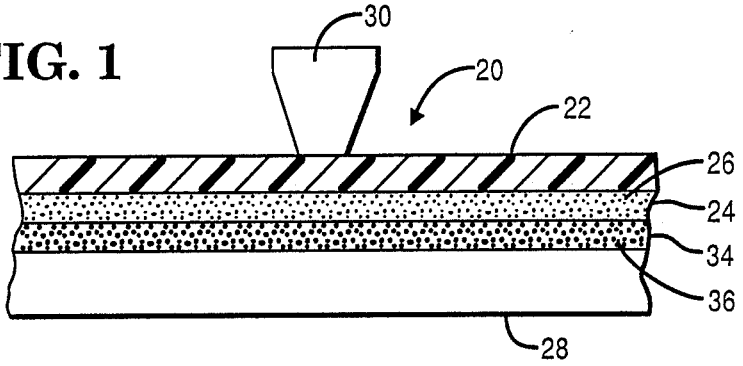
FIG. 1 illustrates a receiving document and a thermal element operating with a ribbon base having a protective coating and a thermal functional coating thereon incorporating the ingredients as disclosed in the present invention.
Figure 2:
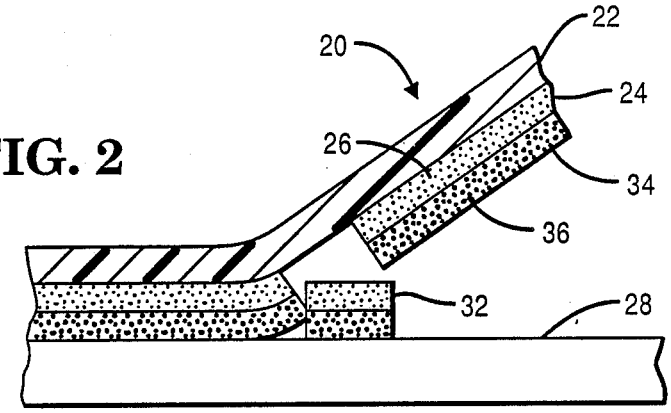
FIG. 2 shows the receiving document with a part of the coating transferred in the form of a digit, symbol or other mark onto the receiving document.

The transfer ribbon 20, as illustrated in FIGS. 1 and 2, comprises a base or substrate 22 of thin, smooth, tissue-type paper or polyester-type plastic or like material having a protective coating or layer 24 on the substrate. The ribbon 20 also has a coating 34 which is thermally activated and includes either magnetic or nonmagnetic pigment or particles 36 as an ingredient therein for use in imaging or encoding operations to enable machine reading, or human reading, or reflectance reading, of characters or other marks. Each character or mark that is imaged on a receiving paper document 28 or like record media produces a unique pattern or image that is recognized and read by the reader. In the case of thermal transfer ribbons relying solely on the nonmagnetic thermal printing concept, the pigment or particles 36 include coloring materials such as pigments, fillers and dyes. The coloring material may include a fluorescent pigment in the nonmagnetic concept. In the case of ribbons relying on the magnetic thermal printing concept, the pigment or particles 36 include magnetic oxides or like sensible materials.

As alluded to above, it is noted that the use of a thermal printer having a print head element, as 30, substantially reduces noise levels in the printing operation and provides reliability in imaging or encoding of paper or like documents 28. The thermal transfer ribbon 20 provides the advantages of thermal printing while encoding or imaging the document 28 with a magnetic or with a nonmagnetic signal inducible ink. When the heating elements 30 of a thermal print head are activated, the imaging or encoding operation requires that the pigment or particles of material 36 in the coating 34 on the coated ribbon 20 be transferred from the ribbon to the document 28 in manner and form to produce precisely defined characters 32 for recognition by the reader. In the case of nonmagnetic thermal printing, the imaging or encoding material 36 is transferred to the document 28 to produce precisely defined characters 32 for recognition and for machine, human, or reflectance reading thereof.

In the case of magnetic thermal printing, the thermal sensitive coating 34 includes the magnetic pigment or particles 36 for use in imaging or encoding operations to enable optical, human, or machine reading of the characters. The magnetic thermal transfer ribbon 20 provides the advantages of thermal printing while encoding or imaging the document 28 with a magnetic signal inducible ink.

The thermal transfer ribbon of the present invention is produced in a two-step coating or layer process wherein the first coating 24 adjacent the substrate 22 is a protective coating or layer and the second coating 34 is a thermal functional coating and includes a specific wax emulsion or formulation.

The protective coating or layer 24 is provided directly on the substrate 22 as an undercoating, and the thermal transfer coating 34 is provided on the side away or distal from the ribbon substrate 22 as an overcoating, as seen in FIGS. 1 and 2. The protective coating or layer 24 exhibits the following characteristics, namely, the coating must be resistant to rubbing and smudging, the coating must not inhibit transfer of the thermal-sensitive material 36 in the coating 34 at normal print head voltage, pulse width and temperature, and the coating 24 must allow a bond of the thermal-sensitive material 36 in the coating 34 onto the paper 28 upon transfer of such material.

Figure 3:
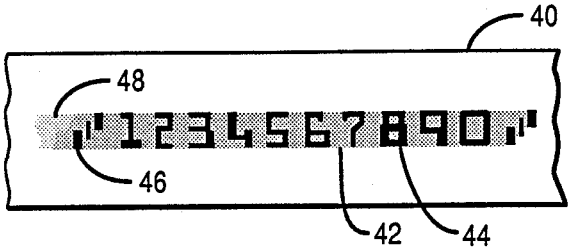
FIG. 3 is a diagrammatic view of a portion of a thermal material receiving medium wherein smearing occurs in unprinted areas adjacent the digit or symbol.

FIG. 3 shows a portion of a document 40 with a strip portion 42 of the document and several of the thermally transferred digits 44 and symbols 46. The darkened strip portion 42 illustrates the effect of smearing or smudging of the ink from the thermally transferred digits 44 or symbols 46 in a machine sorting operation. As the reader reads the digits 44, the read head is in contact with the surface of the digits and causes smearing of ink into the portion 42 adjacent the digits. FIG. 3 illustrates an operation wherein the read head is moving from right to left and the smearing is in the portion 42 to the left of the digits 44 and symbols 46. The portion at 48 shows a decreased smearing effect away from the symbol 46. The smearing or smudging is illustrated as the darkened area strip portion 42 in the unprinted areas adjacent and to the left of the symbols 46 or digits 44. A gradual decrease in the smearing of the ink is intended to be shown in the strip portion 42 to the left of the digits 44 or symbols 46. The illustration in FIG. 3, although exaggerated to show the effect, is exemplary of machine sorting operations that include multiple passes of the document 40 in a high speed sorter.

Figure 4:
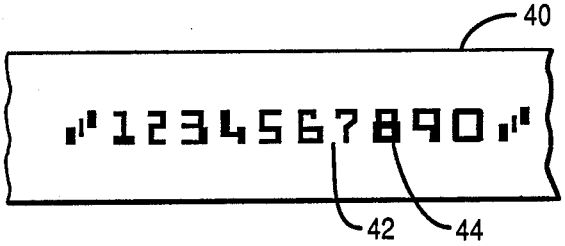
FIG. 4 is a view of a portion of a receiving medium showing the effects of using the protective coating of the present invention to prevent smearing in the unprinted areas.

FIG. 4 shows a portion of the document 40 such as a bank check, similar to that of FIG. 3 and having a plurality of the encoded digits 44. The strip portion 42 surrounding the characters is illustrated as an example of a printed document using a ribbon 20 having the protective layer 24 of the present invention. The protective layer 24 substantially reduces or eliminates any smearing or smudging of the transferred images or digits 44. The illustration in FIG. 4 is also exemplary of machine sorting operations that include multiple passes of the document 40 in a high speed sorter.

The thermal functional coating 34 includes wax emulsion ingredients and thermal coating ingredients. A wax adhesive emulsion of about 35% solids uses hydrocarbon wax, paraffin wax, carnauba wax, and an ethylene/-vinyl acetate copolymer or a hydrocarbon resin soluble in aliphatic solvents. The coating 34 may include a magnetic oxide added to the wax emulsion.

A preferred wax emulsion or formulation to satisfy the requirements of the first coating or the thermal functional coating 34 includes the ingredients in appropriate amounts as set forth in Tables 1 and 2 of Example I.

EXAMPLE I

TABLE 1

| Wax Emulsion | Percent Dry | Wet | % Dry Range |
|---|---|---|---|
| Paraffin 162 Wax | 48.0 | 50.4 | 30–60% |
| WB-17 Wax | 29.0 | 30.4 | 10–40% |
| Carnauba #3 Wax | 12.0 | 12.6 | 5–35% |
| Elvax 40W | 7.0 | 7.4 | 5–25% |
| Irganox 1076 | 4.0 | 4.2 | 0–10% |
| | 100.0 | 105.0 | |
| Mineral Spirits | | 390.0 | |
| Total Wax Emulsion | | 495.0 | |

TABLE 2

| Ingredient | % Dry | Batch Dry | Wet | % Dry Range |
|---|---|---|---|---|
| Wax Emulsion (from above) | 52.5 | 105.0 | 495.0 | 35–90% |
| Iron Oxide | 47.5 | 100.0 | 100.0 | 35–90% |
| | 100.0 | 205.0 | 595.0 | |

The nonvolatile or solid materials in the above formulation are controlled and kept at about 35% and it is here noted that Lacolene, or VM and P Naptha, can be substituted in place of the mineral spirits. The wax adhesive emulsion is heated to approximately 195° F. for a period of about 15 minutes while mixing the above ingredients. After all the ingredients of the wax emulsion have dissolved, the wax emulsion is allowed to cool to about 120° F. and is transferred to conventional grinding or dispersing equipment. The iron oxide of Table 2 is then added to the warm emulsion. The dispersion equipment such as a ball mill, a shot mill, a sand mill, or an attritor is used and the ingredients are ground for a period of approximately 30 minutes, or for a sufficient period of time to provide a uniform fine (3–5 microns size) dispersion.

The second stage of the process includes preparation of the undercoating or protective layer 24 wherein the following ingredients in appropriate amounts, as set forth in Table 3, are mixed together and applied directly to the substrate 22.

TABLE 3

| Undercoating | Percent Dry | Wet | % Dry Range |
|---|---|---|---|
| PVA 107 | 5.0 @ 12% Solids | 42.0 | 1–15% |
| Environmental Ink 1052 (42% Solids) | 12.0 | 28.6 | 4–30% |
| Sucrose Benzoate | 45.0 | 45.0 | 30–60% |
| Behenyl Alcohol | 23.0 | 23.0 | 18–30% |
| Irganox 1035 | 2.0 | 2.0 | 1–10% |
| Carbon Black | 12.0 | 10.0 | 8–16% |
| Surfynol 104 | 1.0 | 1.0 | 0–2% |
| Nopco NDW | Trace | Trace | |
| Water | — | 348.4 | |
| | 100.0 | 500.0 | |

It is to be noted that the Environmental Ink 1052 is supplied as an emulsion wherein the actual percentage of solids for this ink is about 42%. It is also noted that the percentage of solids in the undercoating is about 20%.

Paraffin 162 wax is a mixture of solid hydrocarbons chiefly of the methane series derived from the paraffin distillate portion of crude petroleum and is soluble in benzene, ligroine, alcohol, chloroform, turpentine, carbon disulfide and olive oil. WB-17 is an oxidized, isocyanated hydrocarbon wax. Carnauba #3 is a hard, amorphous wax derived by exudation from leaves of the wax palm and is soluble in ether, boiling alcohol and alkalies. Elvax 40 W is an ethylene vinyl acetate copolymer. Irganox 1076 is a low melting point (50° C.–55°C.) hydracinnamate of phenolic resin used as an anti-oxident. The iron oxide is a reddish or bluish-black amorphous powder in form and magnetic in function, is insoluble in water, alcohol and ether, and is used as a pigment or sensible material.

The PVA 107 is a polyvinyl alcohol used as a binder Environmental ink No. EC 1052 is a printers' ink similar to Latex used in the paper coating industry. No. EC-1052 is a water-based acrylic primer for various vinyl substrates. It has excellent adhesion to many vinyls that water inks or solvent inks alone would not adhere to. EC-1052 adheres to many vinyls, but not all vinyls and for this reason should be evaluated on each stock before using. Irganox 1035 is octadecyl 3,5 di-tertbutyl –4 hydroxyhydracinnamate having a melting point of 60° C.–65° C. and used as an anti-oxident. Behenyl alcohol is a long chain, saturated fatty alcohol which is soluble in alcohol, acetone and ether. Sucrose benzoate is a transfer agent that is compatible with waxes and copolymers. Carbon Black is a black, amorphous powder of relatively coarse particles which is insoluble in solvents, and is used as a pigment. Surfynol 104 is an organic surface-active material used as a wetting agent. Nopco NDW is a defoamer of the glycol group. It is noted that a pigment is defined as a solid that reflects light of certain wavelengths, without producing appreciable luminescence; in effect, pigments are used to impart color to other materials.

The nonvolatile materials of the thermal transfer coating 34 are controlled or kept at approximately 35% for proper viscosity. It should be noted that all ingredients are carefully weighed and solubilized in the mineral spirits using appropriate heat and agitation. After the solution is complete, it is slowly cooled to form a viscous wax dispersion to prepare a thermally active, transfer coating.

The substrate or base 22, which may be 30–40 L gauge capacitor tissue, as manufactured by Glatz, or 14–35 gauge polyester film, as manufactured by duPont under the trademark Mylar, should have a high tensile strength to provide for ease in handling and coating of the substrate. Additionally, the substrate should have properties of minimum thickness and low heat resistance to prolong the life of the heating elements 30 of the thermal print head by reason of reduced print head actuating voltage and the resultant reduction in burn time.

The protective layer 24 is applied to the substrate 22 by means of conventional coating techniques such as a Meyer rod or like wire-wound doctor bar set up on a typical solvent coating machine to provide a coating weight of 1.0 to 2.5 grams per square meter on a 20 gauge polyester film. The protective layer 24 is made up of approximately 20% nonvolatile material and is maintained at a desired temperature and viscosity throughout the coating process. After the protective layer 24 is applied to the substrate 22 and the thermal functional coating 34 is applied to the layer 24, the web of ribbon 20 is passed through a dryer at a temperature in the range between 120° F. and 140° F. for approximately 5–10 seconds to ensure good drying and adherence of the protective layer 24 on the substrate 22 and of the thermal coating 34 on the protective layer 24 in making the transfer ribbon 20. The drying temperature is maintained under 150° F. so that the undercoat or layer 24 and the functional coating 34 are kept nonintegral with each other. The above-mentioned coating weight, as applied by the Meyer rod onto a preferred 9–12 microns thick substrate, overall translates to a total thickness of 12–15 microns. The layer 24 and the coating 34 can be fully transferred onto the receiving substrate 28 in the range between 130° F. and 190° F. by changing the ranges of the waxes used in the first step of the process.

The practice of the invention provides that, upon transfer of the image or character material 36 of the coating 34 onto the paper 28 in a printing operation, the acrylic, water based layer or undercoat 24 remains nonintegral with the solvent based coating 34 and "sits" on top of the transferred image, as seen in FIG. 2. The layer 24 and the coating 34 are separate and distinct and do not mix to form an integral coating. This arrangement and structure of the layer 24 and the coating 34 provides significantly higher resistance to smearing in encoding and sorting operations. In addition to the acrylic ingredients, incorporation of the lower melting temperature of the phenolic resin (hydracinnamate) further improves the smear resistance of the transferred image. Further, the sucrose benzoate enhances the image quality and improves the scratch and smear resistance of the transferred image.

The availability of the various ingredients used in the present invention is provided by the following list of companies.

| Material | Supplier |
|---|---|
| WB-17 Wax | Bareco |
| Paraffin 162 Wax | Boler |
| Carnauba #3 Wax | Baldini & Co., Inc. |
| Elvax 40W Wax | E. I. duPont |
| Iron Oxide | BASF |
| PVA 107 | Air Products |
| Environmental Ink 1052 | Environmental Ink Co. |
| Sucrose Benzoate | Velsicol |
| Behenyl Alcohol | Fallak Chemical |
| Irganox 1035 | Ciba-Geigy |
| Irganox 1076 | Ciba-Geigy |
| Carbon Black | Columbian Carbon |
| Surfynol 104 | Airco Products |
| Nopco NDW | Diamond Shamrock |

It is thus seen that herein shown and described is a thermal transfer ribbon for use in thermal printing operations which includes a protective layer and a thermal responsive coating on one surface thereof. The coated ribbon enables transfer of coating material onto documents or like record media during the printing operation to form digits or symbols or other marks thereon in an imaging or in an encoding nature, permitting machine or other reading of the characters. The protective layer is provided over the thermal responsive coating to resist smearing or smudging of the transferred images or other marks. The present invention enables the accomplishment of the objects and advantages mentioned above, and while a preferred embodiment has been disclosed herein, variations thereof may occur to those skilled in the art. It is contemplated that all such variations and any modifications not departing from the spirit and scope of the invention hereof are to be construed in accordance with the following claims.

What is claimed is:

1. A thermal transfer ribbon comprising a substrate, a thermal sensitive coating which is a mixture containing as essential ingredients about 30 to 60% paraffin wax, about 10 to 40% oxidized, isocyanated hydrocarbon wax, about 5 to 35% carnauba wax, about 5 to 25% acetate copolymer, about 0 to 10% hydracinnamate, and about 35 to 60% iron oxide, and a protective layer between the substrate and the thermal sensitive coating and containing as essential ingredients about 1 to 15% polyvinyl alcohol, about 4 to 30% acrylic primer, about 30 to 60% sucrose benzoate, about 18 to 30% saturated fatty alcohol, and about 8 to 16% carbon black pigment, the thermal sensitive coating being coated on the protective layer and then dried at a temperature wherein the thermal sensitive coating remains nonintegral with the protective layer.

2. The thermal transfer ribbon of claim 1 wherein the hydracinnamate, in the thermal sensitive coating comprises about 0 to 10% octadecyl, di-tertbutyl, hydroxy hydracinnimate.

3. The thermal transfer ribbon of claim 1 wherein the protective layer includes about 1 to 10% hydracinnamate.

4. The thermal transfer ribbon of claim 1 wherein the protective layer includes about 0 to 2% wetting agent.

5. The thermal transfer ribbon of claim 1 wherein the protective layer includes a trace amount of defoamer.

6. The thermal transfer ribbon of claim 1 wherein the thermal sensitive coating has a weight of about 7.5 grams per square meter.

7. The thermal transfer ribbon of claim 1 wherein the protective layer has a weight of about 1.0 to 2.5 grams per square meter.

8. The thermal transfer ribbon of claim 1 wherein the substrate is 30 to 40 gauge capacitor tissue.

9. The thermal transfer ribbon of claim 1 wherein the substrate is 14 to 35 gauge polyester film.

10. A thermal transfer ribbon for use in nonimpact printing comprising a substrate, a thermal sensitive coating which is a mixture containing as essential ingredients about 30 to 60% paraffin wax, about 10 to 40% oxidized, isocyanated hydrocarbon wax, about 5 to 35% carnauba wax, about 5 to 25% acetate copolymer, about 0 to 10% hydracinnamate, and about 35 to 60% iron oxide, and a protective layer between the substrate and the thermal sensitive coating and containing as essential ingredients about 1 to 10% polyvinyl alcohol, about 4 to 30% acrylic primer, about 30 to 60% sucrose benzoate, about 18 to 30% saturated fatty alcohol, about 1 to 10% hydracinnamate, and about 8 to 16% carbon black pigment, the thermal sensitive coating being coated on the protective layer and then dried at a temperature wherein the protective layer remains nonintegral with the thermal sensitive coating.

11. The thermal transfer ribbon of claim 10 wherein the protective layer includes about 0 to 2% wetting agent.

12. The thermal transfer ribbon of claim 10 wherein the protective layer includes a trace amount of defoamer.

13. The thermal transfer ribbon of claim 10 wherein the thermal sensitive coating has a weight of about 7.5 grams per square meter and the protective layer has a weight of about 1.0 to 2.5 grams per square meter.

* * * * *